United States Patent [19]

Cary

[11] 4,444,355

[45] Apr. 24, 1984

[54] CONTAINER COVER ASSEMBLY

[76] Inventor: Robert S. Cary, 120 N. Hunter St., Stockton, Calif. 95202

[21] Appl. No.: 442,693

[22] Filed: Nov. 18, 1982

Related U.S. Application Data

[63] Continuation-in-part of Ser. No. 240,044, Mar. 3, 1981, abandoned.

[51] Int. Cl.[3] ..... B65D 5/68; B65D 43/06

[52] U.S. Cl. ..... 229/43; 220/404; 220/1 T

[58] Field of Search ..... 229/43; 220/403, 404, 220/1 T, 4 A

[56] References Cited

U.S. PATENT DOCUMENTS

| | | | |
|---|---|---|---|
| 2,225,110 | 12/1940 | Hearn | 220/1 T |
| 2,577,304 | 12/1951 | Brooks | 229/43 X |
| 3,118,146 | 1/1964 | Darey | 220/441 |
| 3,127,052 | 3/1964 | Mayers | 220/404 |
| 3,130,853 | 4/1964 | Calthust | 220/404 |
| 3,148,799 | 9/1964 | Meroney | 220/404 |
| 3,741,434 | 6/1973 | Tranuse | 220/404 |
| 3,815,778 | 6/1974 | Martin | 220/404 |
| 3,818,956 | 6/1974 | Chamberlain | 220/404 |
| 3,944,127 | 3/1976 | Bruke | 229/7 R |

*Primary Examiner*—Herbert F. Ross
*Attorney, Agent, or Firm*—Townsend and Townsend

[57] ABSTRACT

A cover assembly including a frame and a lid for placement over the open top of a container. The frame has a circumferential side which fits snugly around the sides of the open container and a relatively short inwardly extending lip along its upper edge to support the frame on the rim of the container. The lip has an inner edge defining an access opening. A portion of the inner edge is set back away from the inside surface of the container so the lip at such portion does not interfere with removal of the contents. A lid, supported by a recessed lid sealing surface on the lip, covers the access opening. The container is typically a rectangular cardboard box having flaps folded up and back down along the sides of the box. The box typically contains a product in a plastic bag conforming to the interior of the box. The bag is sufficiently tall so that the bag opening can be drawn out and cover the downwardly folded flaps. The frame is placed over the open top of the box so that the sides of the frame lie snugly against the outwardly and downwardly folded bag and flaps. Convenient access to the product is thereby achieved.

5 Claims, 3 Drawing Figures

CONTAINER COVER ASSEMBLY

DESCRIPTION

This is a continuation-in-part of U.S. patent application Ser. No. 240,044, filed Mar. 3, 1981, now abandoned.

BACKGROUND OF THE INVENTION

Restaurants and other such food establishments often buy supplies in relatively large containers. For example, mayonnaise is often sold in 30 pound, 4 gallon plastic jars having screw-off lids. Another way in which mayonnaise is distributed is in a cardboard box having a plastic bag within the box for holding the mayonnaise. The bag is larger than the interior of the box so that the mayonnaise in the bag conforms to the shape of the box. Buying supplies, such as mayonnaise, in a box offers a significant savings to the user over purchasing the product in a plastic jar.

However, opening the cardboard box containing ingredients such as mayonnaise is a messy job and somewhat time consuming. Typically, first the user takes the folded over flaps of the box and bends them back away from the top of the box and down along the side of the box. A keeper or tie is removed from the plastic bag and the open top of the bag is folded back down over the downwardly extending flaps of the box to expose the mayonnaise within. The inside surface of the plastic bag, now facing outwardly and stretched over the outside of the cardboard box, must be wiped off as it has mayonnaise on it. To keep foreign matter out of the product, the bag is usually resealed after a quantity of the product is removed. The requirement to reseal the boxes is especially acute when the boxes are to be stacked on top of one another. When so stacked the bag must be sealed, to keep out foreign matter, and the flaps must be folded back over the top to provide the required strength to the box. The next time the product is needed, the process must be repeated. Thus, although the cardboard box type of container can offer a significant savings to a user, such as a restaurant owner, its use is less convenient, messier and more time consuming than other more convenient, but more costly, containers.

SUMMARY OF THE INVENTION

The present invention solves some of the shortcomings associated with using cardboard box containers by providing a cover assembly having a frame which fits over the oven top of the box and an easily removable lid to cover the access opening of the frame.

A cover assembly for placement over the open top of a container includes a frame and a lid. The frame has a circumferential side which fits snugly around the sides of the open container. The frame has an inwardly extending lip along its upper edge so that when the frame is placed over the open top of the container, a box sealing surface on the underside of the lip rests on the rim of the container. The lip extends inwardly only a short distance so that substantially the entire open top of the container is accessible through the access opening defined by the inner edge of the lip.

The lip has a cut-out adjacent its inner edge providing a lid sealing surface upon which the lid rests. The lid has a recessed handle mounted on the top surface, to enhance stacking, and is configured to completely cover the access opening.

The container is typically a rectangular cardboard box having flaps which can be folded up and back down along the sides of the box. The box typically contains a food substance, such as mayonnaise, in a plastic bag comforming to the interior of the box. The bag is sufficiently tall so that the bag opening can be drawn up, out and over the folded flaps. After wiping the outwardly folded bag, the frame is placed over the open top of the box so that the sides of the frame lie snugly against the outwardly and downwardly folded bag and flaps to keep them in place. Thus, the user need merely remove the lid, which normally covers the access opening, to provide access to the product within the box.

A primary advantage accruing from the present invention is convenience. The user need merely open the box once, with its typically attendant procedures of folding the flaps, untying the bag, folding the bag over the flaps, and cleaning off the outwardly folded bag. After this is done, the frame is placed over the outwardly and downwardly folded flaps and bag to secure them in place. The user gains access to the contents of the box merely by removing the lid covering the access opening in the frame. Additionally, the frame acts to stiffen the box and make it more rigid. Since access to the product is convenient, the user is much less likely to leave the box open for an extended period of time, a significant advantage with foodstuffs. Further, smaller amounts of the product can be withdrawn without causing undue burden which would otherwise result from the repeated opening and closing of the plastic bag. Therefore, freshness of food, such as mayonnaise, can be assured. The cover assembly, preferably made from an easily cleaned plastic material, can be reused.

The lid and the lip cut-out are preferably configured so that the upper surface of the lid, including the top of the recessed handle, is about flush with the upper surface of the lip. This permits several boxes with cover assemblies fitted thereto to be stacked on top of one another. The cover assembly both seals the contents and provides the necessary structural rigidity to the box to do so. Valuable floor and cooler space can be conserved using the invention.

The inner edge of the lip extends inwardly past the inner surface of the box over most of its length. At one corner of the frame the lip cut-out is much smaller so that the inner edge of the lip overlies the folded-over rim of the box while still providing a lid sealing surface around the entire access opening. This set-back inner edge portion allows the product to be scooped out of the box in a natural way. That is, the scoop or spoon can be dragged upwardly against the corner of the box below the set-back inner edge portion past the box rim without the scoop catching on the frame. The set-back inner edge is more sanitary since the product does not collect under it.

Other features and advantages of the present invention will be apparent from the following description in which the preferred embodiment has been set forth in detail in conjunction with the accompanying drawings.

DETAILED DESCRIPTION OF THE PREFERRED EMBODIMENTS

Figure 1:
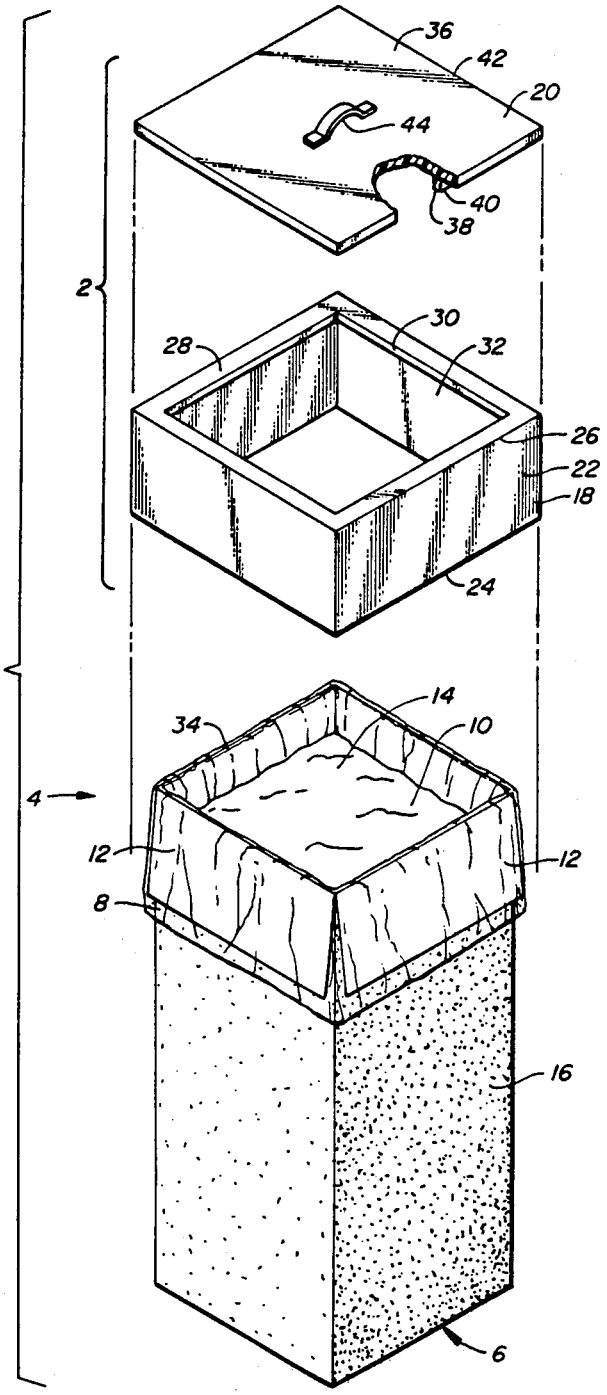
FIG. 1 shows an exploded view of a first embodiment of the cover assembly of the present invention situated above an open container.

FIG. 1 shows a cover assembly 2 in exploded relationship above a container 4. Container 4 is a rectangular cardboard box in which a plastic bag 8 holding a product 10, such as mayonnaise, is located therein. Flaps 12 are folded away from open top 14 of box 6 and down against circumferential sidewall 16 of box 6. Plastic bag 8 is shown folded down over flaps 12 thus exposing product 10.

Cover assembly 2 includes generally a rectangular frame 18 and a lid 20. Frame 18 includes a circumferential side 22 having a lower edge 24 and an upper edge 26. A lip 28 extends uniformly inwardly from upper edge 26. An inner edge 30 of lip 28 defines an access opening 32 within frame 18.

To maintain the outwardly and downwardly folded flaps 12 and plastic bag 8 in position, frame 18 is placed over open top 14 of box 6. Circumferential side 22 is sized slightly larger than circumferential sidewall 16 so that frame 18 fits snugly over the outwardly folded flaps 12 and plastic bag 8 of container 4. Lip 28 rests on a rim 34 of box 6.

Lid 20 includes a planar upper portion 36 and a downwardly extending rib 38. The outer edge 40 of rib 38 is sized to fit adjacent inner edge 30. The outer edge 42 of upper portion 36 extends outwardly from outer edge 40 so that access opening 32 is sealed by placing lid 20 on frame 18 so that rib 38 mates within access opening 32 and upper portion 36 lies against lip 28 of frame 18. A handle 44 is attached centrally to lid 20 to allow the lid to be easily removed from the frame.

Although the use of the present invention should now be apparent, the following is a brief description of its use. The user opens flaps 12 of cardboard box 6 and folds them outwardly to lie adjacent sidewall 16. Plastic bag 8 containing product 10 within box 6 has a keeper or tie, not shown, removed and the top of the bag is folded down over the downwardly folded flaps. If needed, portions of plastic bag 8 overlying flaps 12 are wiped clean of any product which may stick thereto. Frame 18 is then placed over outwardly folded flaps 12 in bag 8 until rim 34 supports lip 38. Lid 20 is used to cover access opening 32 and is removed when desired by the user.

Figure 2:
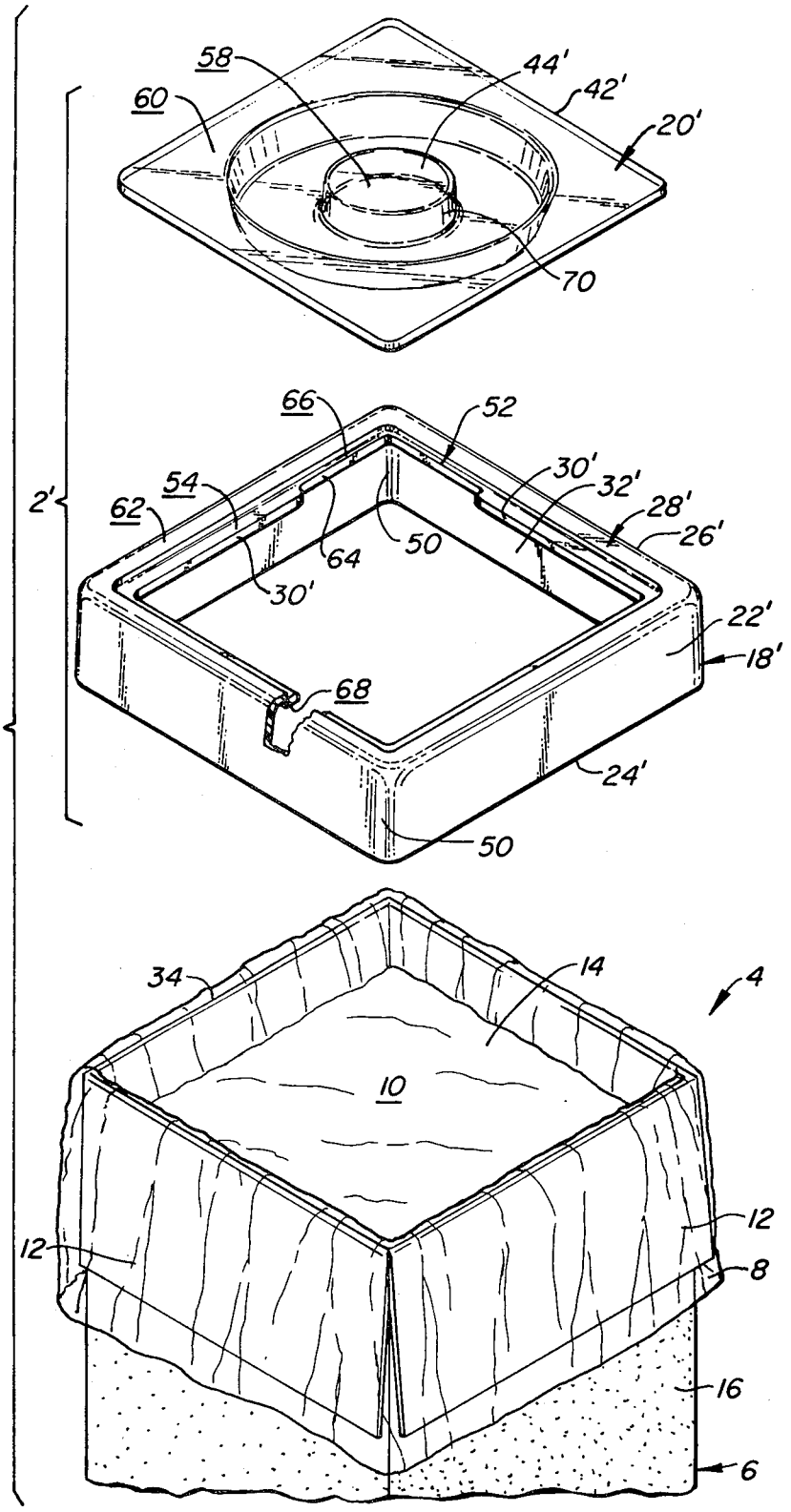
FIG. 2 is an exploded view of a second embodiment of the cover assembly of the invention.
Figure 3:
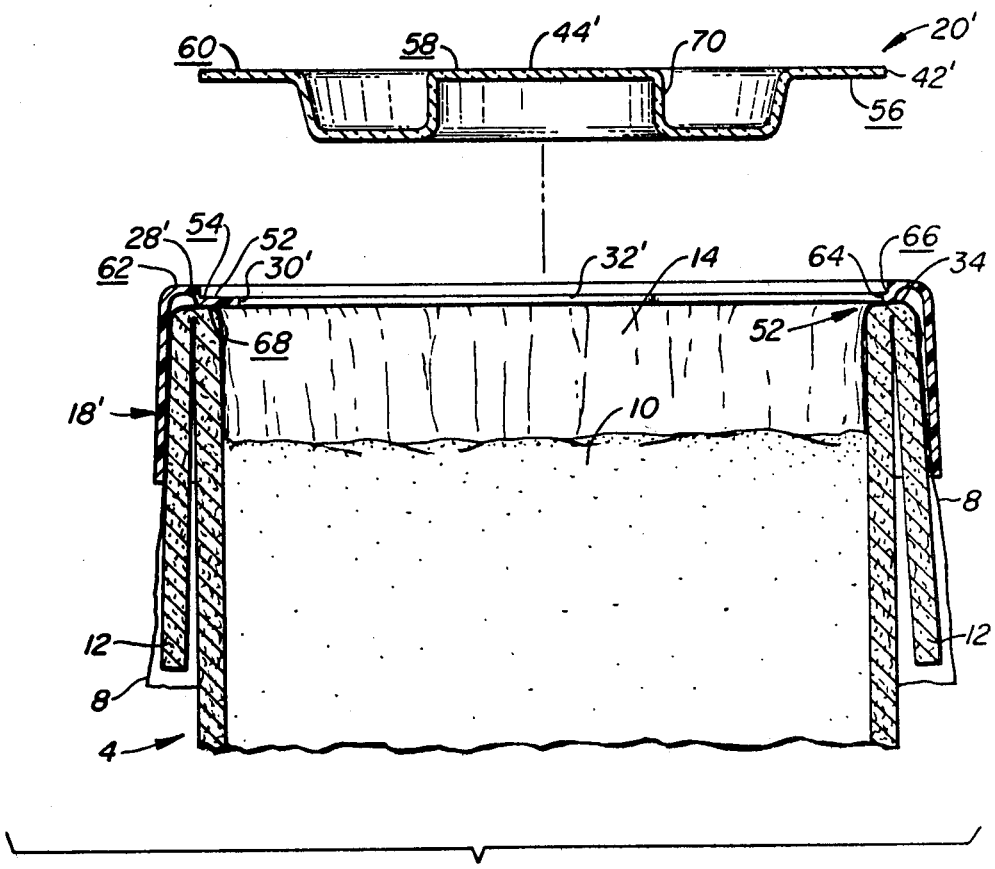
FIG. 3 is a cross-sectional view of the frame, mounted to a container, and cover of FIG. 2.

Turning now to FIGS. 2 and 3, an alternative embodiment of the present invention will be described. Cover assembly 2' is similar to cover assembly 2 with the following primary distinctions. Frame 18' has rounded corners 50 in lieu of the square corners of frame 18. The inside radius of corner 50, as well as the size of rectangular frame 18', is chosen according to the size of a particular container 4 with which it is to be used. By appropriately sizing frame 18' and corner 50, a good seal between frame 18' and plastic bag 8 covering flaps 12 can be achieved.

Lid 20' includes a recessed portion 52 in lip 28' adjacent inner edge 30' and surrounding access opening 32'. Recessed portion 52 provides a lid sealing surface 54 on which the periphery of the lower surface 56 of lid 20' rests.

The outer edge 42' of lid 20' is sized to fit within recessed portion 52 to seal access opening 32'. A generally cylindrical recessed handle 44' formed within lid 20' has an upper surface 58 generally co-planar with the upper surface 60 of the remainder of lid 20'. Lower surface 56 of lid 20' is preferably formed without sharp corners to facilitate cleaning. When lid 20' is mounted to frame 18', surfaces 58, 60 are generally coplanar with the upper surface 62 of lip 28. This allows several containers 4, covered by cover assemblies 2', to be stacked one upon the other.

A portion 64 of inner edge 30' is set back from the interior of frame 18'. This set-back edge portion 64 overlies a portion of rim 34 of container 4, as shown in FIG. 3. This set-back allows a scoop to be drawn up against plastic bag 8 at the corner of container 4 below portion 64 without catching on recessed portion 52. This also reduces the accumulation of product 10 under lip 28' to reduce spoilage and the introduction of off flavors. An abbreviated portion 66 of sealing surface 54 permits the maintenance of the seal between lid 20' and frame 18' around the entire periphery of lid 20'. The seal between the lower box sealing surface 68 of lip 28' and box rim 34 is also maintained around the entire rim even beneath portion 64.

Lid 20' can be made of a clear plastic material so that its product can be viewed without removing the lid. The grip surface 70 on handle 44' is preferably roughened, such as by etching or sand blasting, to increase friction. The product can be dry or moist and is not limited to food. Other modification and variation can be made to the disclosed embodiment without departing from the subject of the invention as defined in the following claims.

I claim:

1. A container cover assembly for use with a container having a circumferential sidewall terminating in an open end, said open end defined by a rim, comprising:

a frame having a downwardly extending circumferential side, said side having upper and lower edges, said side sized for engagement around said open end to circumscribe said open end and lie adjacent said sidewall of said container;

said frame having an inwardly extending lip portion supporting said frame on said rim, said lip portion having an inner edge defining an access opening to said container, said access opening sized so that a substantial portion of the open end of said container is free from overlying material;

said inner edge including a set-back portion directly overlying the container rim to allow the contents of the container to be scooped out of the container; and a lid adapted for removable engagement with said frame and sized to completely cover said access opening.

2. The container cover assembly of claim 1 wherein:

said lip includes a recessed portion adjacent said inner edge defining a lid sealing surface about the access opening; and said lid includes a circumferential portion sized for engagement within said recessed portion, said circumferential portion including surface means for sealable engagement with said lid sealing surface.

3. The container cover assembly of claim 1 wherein said lid includes an upper lid surface and a recessed handle, said handle generally at or below said upper lid surface thereby enabling containers covered by the container covers to be stacked on top of one another.

4. The container cover assembly of claim 3 wherein said lip includes a top surface and a recessed portion sized for receipt of a circumferential portion of the lid, said recessed portion sized so said top surface and said upper lid surface are generally coplanar.

5. A container cover assembly specially adapted for use with a rectangular cardboard box having an inside surface and end flaps which can be folded back and down along the sides of the box to create an open end bounded by a box rim, the box containing a bag for containment of a product within said box, said bag having an open top sized to be extended out and down over the downwardly folded end flaps to allow the user access to the product through said open end, the cover assembly comprising:

a rectangular frame sized to circumscribe and snugly fit around the downwardly folded end flaps and bag;

a lip, extending inwardly from said frame, having an inner edge defining an access opening and having a lower surface engaging said box rim to support said frame around said folded end flaps and bag, said lip sized so that said open end of said box is substantially free from overlying material;

removable lid means for completely covering said access opening thereby allowing a user selective access to the contents of said box, said lid means including a recessed handle;

said lip including a recessed portion for providing a sealing surface on which said lid rests; and said inner edge including a set-back portion set back from the inside surface of the box so the portion of said lip bounded by said set-back portion of said inner edge does not overlie said inside surface.

* * * * *